US008120555B2

(12) United States Patent
Cok

(10) Patent No.: US 8,120,555 B2
(45) Date of Patent: Feb. 21, 2012

(54) LED DISPLAY WITH CONTROL CIRCUIT

(75) Inventor: Ronald S. Cok, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 1145 days.

(21) Appl. No.: 11/934,152

(22) Filed: Nov. 2, 2007

(65) Prior Publication Data

US 2009/0115703 A1 May 7, 2009

(51) Int. Cl.
*G09G 3/32* (2006.01)

(52) U.S. Cl. ..... 345/82; 345/55; 345/204

(58) Field of Classification Search ..... 345/82, 345/55, 204

See application file for complete search history.

(56) References Cited

U.S. PATENT DOCUMENTS

| | | | | |
|---|---|---|---|---|
| 5,786,796 | A | 7/1998 | Takayama et al. | |
| 6,392,617 | B1 * | 5/2002 | Gleason | 345/82 |
| 6,670,773 | B2 | 12/2003 | Nakamura et al. | |
| 6,738,031 | B2 * | 5/2004 | Young et al. | 345/55 |
| 6,809,710 | B2 | 10/2004 | Prache et al. | |
| 7,088,051 | B1 | 8/2006 | Cok | |
| 2002/0140659 | A1 | 10/2002 | Mikami et al. | |
| 2003/0112205 | A1 | 6/2003 | Yamada | |
| 2007/0091030 | A1 | 4/2007 | Drevillon et al. | |

FOREIGN PATENT DOCUMENTS

| | | |
|---|---|---|
| EP | 1 061 497 A1 | 12/2000 |
| WO | 03/034389 | 4/2003 |
| WO | 2004/036536 | 4/2004 |

* cited by examiner

*Primary Examiner* — Richard Hjerpe
*Assistant Examiner* — Leonid Shapiro
(74) *Attorney, Agent, or Firm* — Morgan, Lewis & Bockius LLP

(57) ABSTRACT

An active-matrix circuit for controlling an LED display pixel that includes a control circuit responsive to control signals for storing a luminance value in a storage circuit during a frame period. A drive circuit responds to the storage circuit for controlling current through an LED to emit light at a luminance level determined by the luminance value. A luminance-value reduction circuit, connected to the storage circuit, provides a controlled reduction of the luminance value stored in the storage circuit during the frame period.

17 Claims, 8 Drawing Sheets

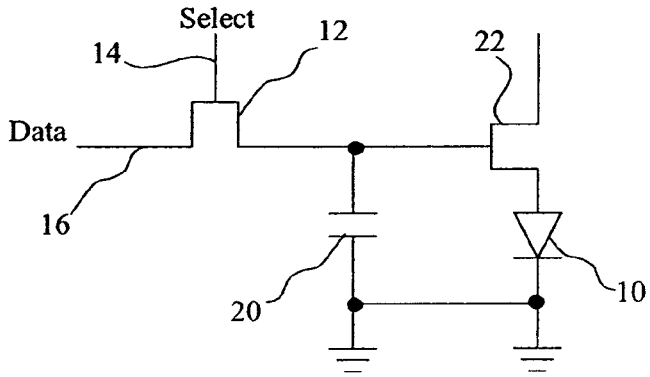
Fig. 12 - Prior Art
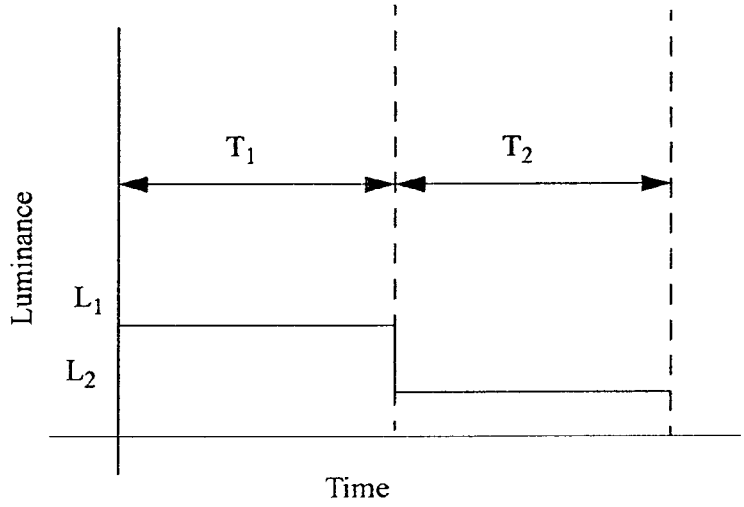
Fig. 13a - Prior Art
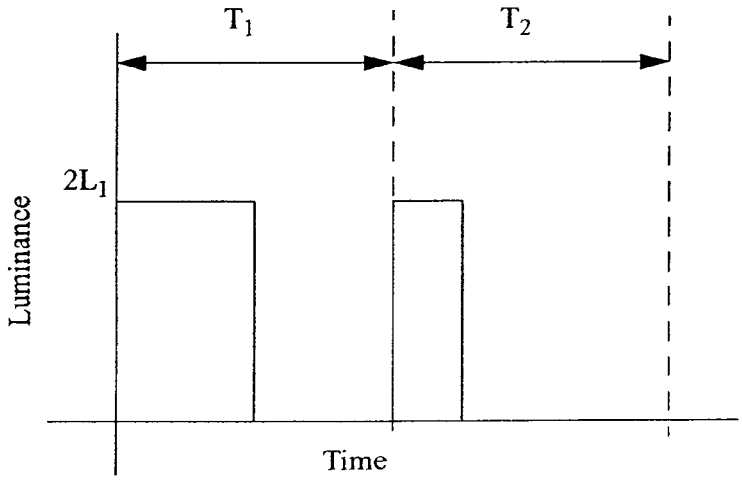
Fig. 13b - Prior Art

LED DISPLAY WITH CONTROL CIRCUIT

FIELD OF THE INVENTION

The present invention relates to solid-state display devices and means to store and display pixel values and images.

BACKGROUND OF THE INVENTION

Solid-state image display devices utilizing light-emissive pixels are well known and widely used. For example, OLED devices are used in flat-panel displays, in both passive- and active-matrix configurations, and in both top-emitter and bottom-emitter designs. Control circuits for OLED displays are also well known in the art and include both voltage- and current-controlled schemes.

Conventional passive-matrix OLED displays employ drivers to conduct current through an OLED element over a fixed period (also known as a frame or frame period) during which the OLED light-emitting element emits light at a specific luminance. Successive rows or columns of OLED elements are energized and the entire OLED display is refreshed at a rate sufficient to avoid the appearance of flicker. For example, WO 2003/034389 entitled, "System and Method for Providing Pulse Amplitude Modulation for OLED Display Drivers," published Apr. 24, 2003, describes a pulse width modulation driver for an organic light emitting diode display. One embodiment of a video display comprises a voltage driver for providing a selected voltage to drive an organic light emitting diode in a video display. The voltage driver may receive voltage information from a correction table that accounts for aging, column resistance, row resistance, and other diode characteristics.

In contrast, active-matrix circuits employ a two-dimensional array of individual circuits for each light-emitting element in a display. The active-matrix circuit provides a control mechanism for storing a value (typically as a charge on a capacitor) that is then employed to control a drive circuit to provide current through the light-emitting element (also known as a pixel or sub-pixel). As used herein, each light-emitting element is considered to be a pixel, regardless of color or grouping with other light-emitting elements. For example, referring to FIG. 12, an active-matrix pixel circuit for driving an LED 10 includes a control transistor 12 responsive to control signals such as a select signal 14 and data signal 16. Upon activation of select signal 14, the control transistor 12 is turned on and data signal 16 provides a charge to a storage capacitor 20. The control transistor 12 is subsequently turned off by deactivation of select signal 14. The charge stored on the storage capacitor 20 turns on driving transistor 22 to provide current to LED 10 at a level commensurate with the charge stored on capacitor 20. Referring to FIG. 13*a*, a pixel might emit light at a luminance level $L_1$ during a first frame period $T_1$ and at a second luminance level $L_2$ during a second frame period $T_2$. The changes in luminance are perceived by an observer as changes in an image, for example, motion in a scene.

In a conventional, prior-art flat-panel display, a display signal is typically refreshed periodically at a rate high enough to provide the appearance of smooth motion in sequential frames of a video stream. Refresh rates are typically 30, 60, 70, 75, 80, 90, or 100 frames per second for monitors, 50 or 60 frames per second for televisions. Hence, in a conventional flat-panel display, the charge in the charge storage capacitor 20 is updated at the selected refresh rate appropriate to the application.

The luminance value at each pixel is typically refreshed at a refresh rate (for example 30 Hz or 60 Hz) defining a frame period. The frame period is chosen to be sufficiently short so that the illusion of motion is provided when the luminance values of the pixels change. As is known, such active-matrix circuits can cause motion blur in observers, because the image is static during a frame period while an observer's eye may track across the display, exposing the image to different portions of the retina. This blur can be reduced by reducing the period of the refresh, that is refreshing at a higher frequency. However, such a solution is problematic, in that higher frequency signals are employed, raising the cost of drivers and exacerbating transmission line effects in the control lines used to store charge at each pixel location. Alternatively, the time during each frame for which the pixel is emitting light may be reduced, for example, by emitting brighter light during only a portion of the frame time. If the frame period is sufficiently short, no flicker will be perceived. Referring to FIG. 13*b*, during a first frame period $T_1$, a pixel may be controlled to emit twice the light $2L_1$ during one half of the period $T_1$ and similarly emit light at twice the luminance level $2L_2$ during one half of the period $T_2$. In a related solution, portions of a display may display a black bar that scrolls across the display. However, these solutions also require higher-frequency controls that raise costs and are problematic for larger displays with longer control lines.

Known pulse-width modulation techniques may be employed to control a display pixel as illustrated in FIG. 13*b*. Moreover, because one source of non-uniformity in an OLED display results from variability in the threshold switching characteristics of thin-film drive transistors employed in active-matrix designs, one approach to improving uniformity in an active-matrix OLED display is to employ pulse-width modulation techniques in contrast to charge-deposition control techniques. These pulse-width modulation techniques operate by driving the OLED at a maximum current and brightness for a specific first amount of time and then turning the OLED off for a second amount of time within the same frame time. If the sum of the first and second amounts of time is sufficiently small, the flicker resulting from turning the OLED on and off periodically will not be perceptible to a viewer. The brightness of the OLED element is controlled by varying the ratio of amount of time that the OLED is turned on in comparison to the amount of time that the OLED is turned off.

A variety of methods for controlling an OLED display using pulse-width modulation are known. For example, U.S. Pat. No. 6,809,710 entitled, "Gray scale pixel driver for electronic display and method of operation therefore" granted Oct. 26, 2004, discloses a circuit for driving an OLED in a graphics display. The circuit employs a current source connected to a terminal of the OLED operating in a switched mode. The current source is responsive to a combination of a selectively set cyclical voltage signal and a cyclical variable amplitude voltage signal. The current source, when switched on, is designed and optimized to supply the OLED with the amount of current necessary for the OLED to achieve maximum luminance. When switched off, the current source blocks the supply of current to the OLED, providing a uniform black level for an OLED display. The apparent luminance of the OLED is controlled by modulating the pulse width of the current supplied to the OLED, thus varying the length of time during which current is supplied to the OLED.

By using a switched mode of operation at the current source, the circuit is able to employ a larger range of voltages to control the luminance values in a current-driven OLED display. However, use of current-driven circuits is complex and requires a large amount of space for each pixel in a display device.

There are also methods known for providing both a pulse width control and a variable charge deposition control in a single circuit. U.S. Pat. No. 6,670,773 entitled, "Drive circuit for active matrix light emitting device," suggests a transistor in parallel with an OLED element. The described technique, however, diverts driving current from an OLED, thereby, decreasing the operating efficiency of the circuit. Other designs employ circuit elements in series with the OLED element for controlling or measuring the performance of the OLED element. For example, WO 2004/036536 entitled, "Active Matrix Organic Electroluminescent Display Device" published Apr. 29, 2004, illustrates a circuit having additional elements in series with an OLED element. However, when placed in series with an OLED element, transistors will increase the overall voltage necessary to drive the OLED element or may otherwise increase the overall power used by the OLED element or decrease the range of currents available to the OLED element.

In U.S. Pat. No. 7,088,051, by Cok, issued Aug. 8, 2006, a pulse-width modulation scheme with a variable control is disclosed and is hereby incorporated in its entirety by reference. This disclosure describes a means for controlling the luminance of a pixel during a frame time; however, external control is required, thereby increasing costs and reducing aperture ratio of the device.

There is a need, therefore, for an improved control circuit for active-matrix OLED devices having a simplified and flexible design.

SUMMARY OF THE INVENTION

In accordance with one embodiment, the invention is directed towards an active-matrix circuit for controlling an LED display pixel, comprising:

a) a control circuit responsive to control signals for storing a luminance value in a storage circuit during a frame period;

b) a drive circuit responsive to the storage circuit for controlling current through an LED to emit light at a luminance level determined by the luminance value; and c) a luminance-value reduction circuit connected to the storage circuit that controls a reduction of the luminance value stored in the storage circuit during the frame period.

BRIEF DESCRIPTION OF THE DRAWINGS

FIG. 12 is a prior-art active-matrix pixel-circuit diagram;

FIGS. 13*a* and 13*b* are timing diagrams illustrating pixel luminance according to control methods known in the prior art;

ADVANTAGES

The present invention provides an OLED control device having a simplified control structure while providing improved performance.

DETAILED DESCRIPTION OF THE INVENTION

Figure 1:
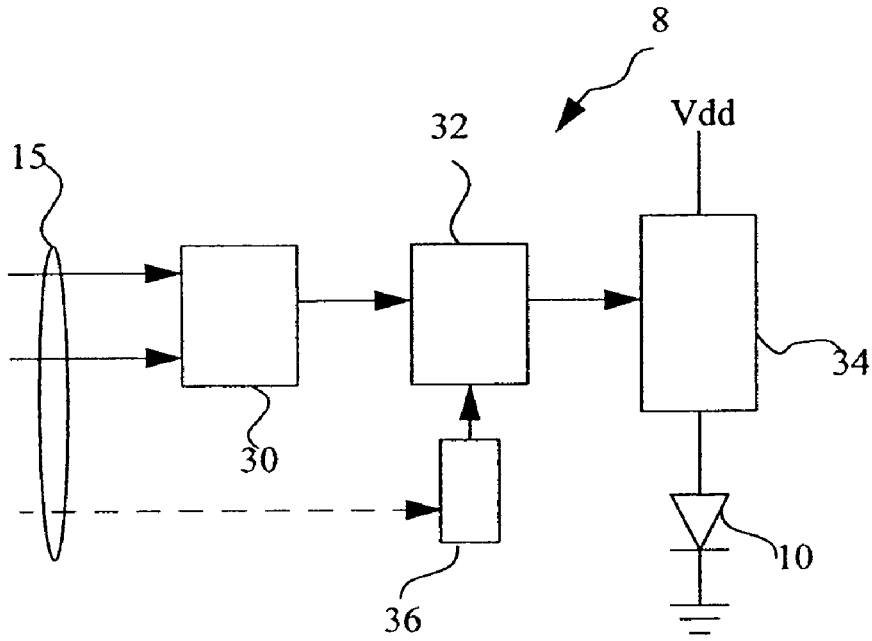
FIG. 1 is a block diagram illustrating the components of the present invention.

Referring to FIG. 1, according to one embodiment of the present invention an active-matrix circuit 8 for controlling an LED display pixel, comprises a control circuit 30 responsive to control signals 15 for storing a luminance value in a storage circuit 32 during a frame period, a drive circuit 34 responsive to the storage circuit 32 for controlling current through an LED 10 to emit light at a luminance level determined by the luminance value, and a luminance-value-reduction circuit 36 connected to the storage circuit 32 that controls a reduction of the luminance value stored in the storage circuit 32 during the frame period. The controlled reduction of the luminance value may be analog or digital and be continuous or discontinuous. However, as employed herein the controlled reduction preferably has at least two states, such as on and off. Such a two-state control is employed in pulse-width modulation schemes that are not included in the present invention. As employed herein, the controlled reduction of luminance value in the storage circuit changes the luminance value from a first non-zero value to a second, smaller value, and then to a third value smaller than the second value. The third value may be, but is not necessarily, zero.

Figure 2:
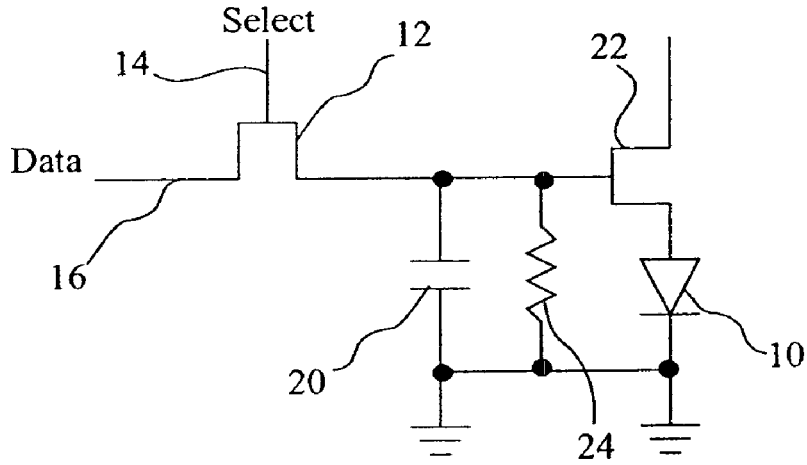
FIG. 2 is a circuit diagram illustrating one embodiment of the present invention.
Figure 11:
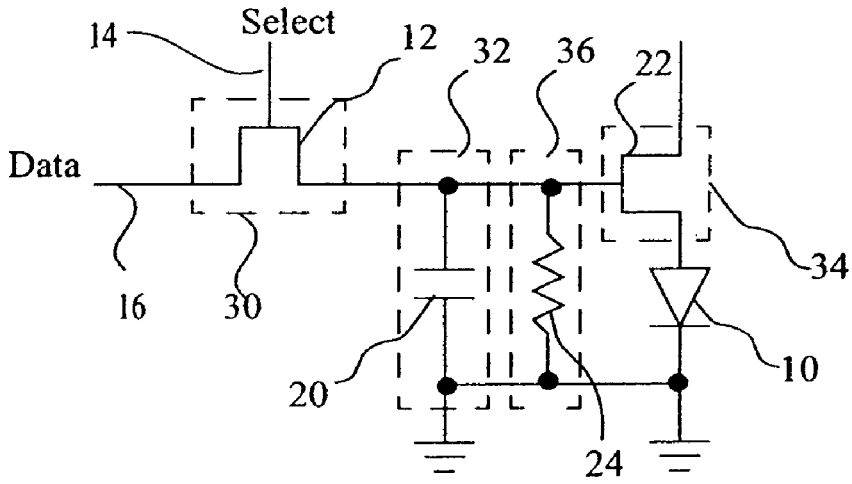
FIG. 11 is a circuit diagram illustrating circuit elements and a block diagram according to an embodiment of the present invention.

Referring to FIG. 2, in one exemplary embodiment of the present invention, the control circuit 30 or drive circuit 34 (of FIG. 1) is illustrated as a transistor 12 or 22 respectively, formed on a substrate; for example, made of low-temperature polysilicon, crystalline silicon, or amorphous silicon. The storage circuit 32 can be a capacitor 20 for storing a charge representative of the luminance value. In this case, the luminance-value reduction circuit 36 can decrease the charge stored in the capacitor 20 over time. In a further embodiment, as shown in FIG. 2, the luminance-value reduction circuit 36 is a resistor 24 connected in parallel across the capacitor 20. $V_{dd}$ of FIG. 1 is a voltage supply source and the circuit is illustrated with a ground voltage reference, although other reference voltages can be employed for the various circuit elements. Referring to FIG. 11, an illustration of the elements of FIG. 1 (illustrated with dashed lines) are shown in conjunction with the elements of FIG. 2.

Figure 3:
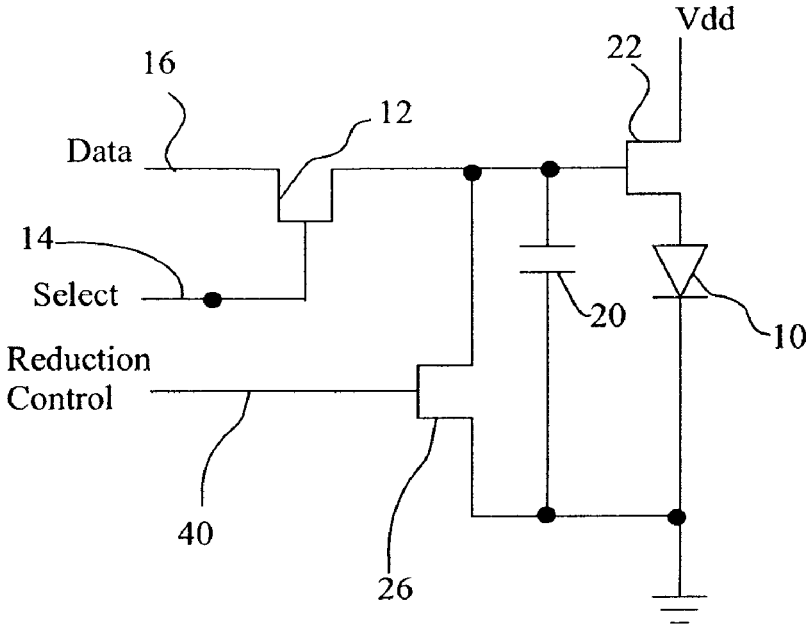
FIG. 3 is a circuit diagram illustrating another embodiment of the present invention.

In an alternative exemplary embodiment illustrated in FIG. 3, the luminance-value reduction circuit 36 is a transistor 26 connected in parallel across the capacitor 20 and responsive to a reduction-control signal 40 to control the rate at which the charge in capacitor 20 decreases over time.

Figure 5:
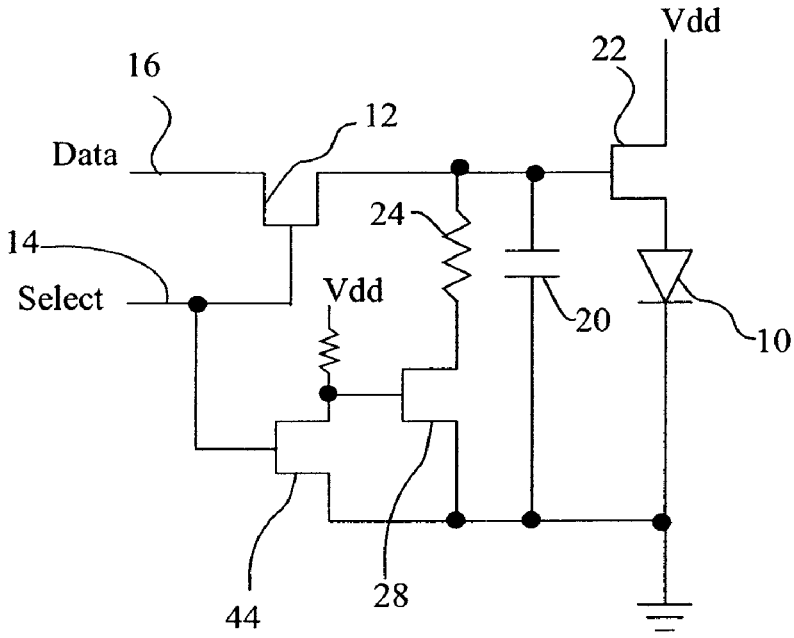
FIG. 5 is a circuit diagram illustrating an alternative embodiment of the present invention.
Figure 4:
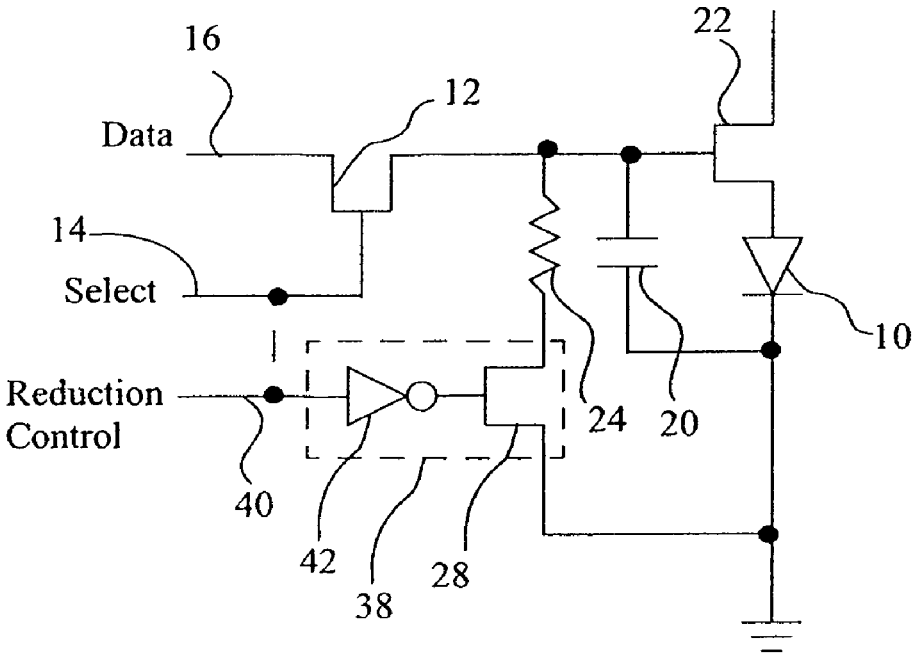
FIG. 4 is a circuit diagram illustrating yet another embodiment of the present invention.

In a further exemplary embodiment of the present invention illustrated in FIG. 4, a reduction-control circuit 38 responsive to a reduction-control signal 40 is connected to the luminance-value-reduction circuit 36 to control the rate at which the luminance-value-reduction circuit 36 reduces the luminance value. As shown in FIG. 4, the reduction-control circuit 38 comprises a reduction-control transistor 28 in series with a resistor 24 (comprising the luminance-value reduction circuit 36) to control the flow of current through the resistor 24 in response to a reduction-control signal 40. The reduction-control signal 40 can directly control the reduction-control transistor 28 (not shown) or the reduction-control signal 40 can be derived from the select signal 14 (shown with a dashed line) through an inverter 42 so that the luminance value is only reduced when the select signal 14 is not active. Referring to FIG. 5, such an inverter 42 may comprise an inverting transistor 44. Hence, an external control is not necessary for the controlled luminance value reduction to take place, as shown in FIGS. 2 and 5.

Figure 6:
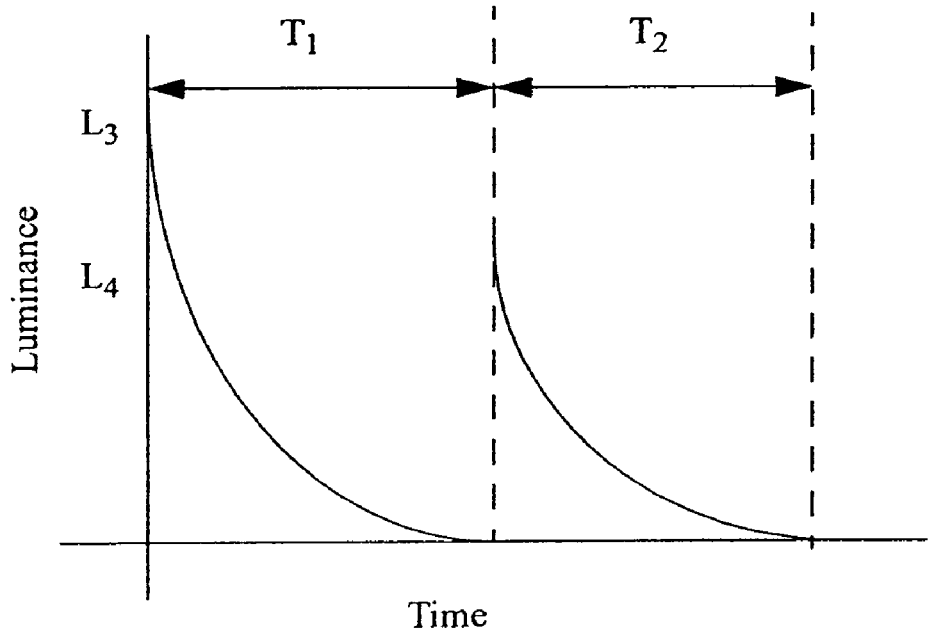
FIG. 6 is a timing diagram illustrating pixel luminance according to an embodiment of the present invention.

In operation, the pixel circuit stores a charge in the storage circuit as described with reference to FIG. 12 above. When the capacitor 20 is charged, the drive transistor 22 is proportionally turned on to provide a current flow from the power signal Vdd, through the drive transistor 22 and the LED 10 to the cathode ground voltage, thereby causing the LED to emit an amount of light corresponding to the charge on capacitor 16. According to the present invention, however, once a luminance value is stored in the storage circuit and the drive circuit is causing the LED to emit light, the luminance value decreases, for example by discharging through a resistor (as shown in FIG. 2) or through a transistor (as shown in FIG. 3). The rate at which the discharge takes place depends on the selection of resistance and capacitor values (as shown in FIG. 2) or the control mechanism employed (as shown in FIG. 3). The discharge can be continuous and exponential or may have some other decreasing curve. Referring to FIG. 6, the result can be that the luminance of the LED is decreased over time within the refresh period $T_1$ from a luminance level $T_3$ to zero; and reduced from a luminance level $T_4$ to zero in a second refresh period $T_2$. Note that to maintain an apparently similar brightness to active-matrix circuits of the prior art (as shown in FIG. 13*a*), the area under the luminance curves should preferably be the same. The average brightness of the LED device is perceived to be the total amount of light emitted during the refresh period. Hence, $T_3$ will be larger than $T_1$, just as $T_2$ is in FIG. 13*b*. As shown in FIG. 6, the controlled reduction of the luminance value begins, without substantial delay, as soon as the deposition cycle is complete, i.e. when the select signal is deactivated. By without substantial delay is meant that the controlled reduction begins when the select signal is deactivated and any control signal 40, if present, is activated.

Figure 7:
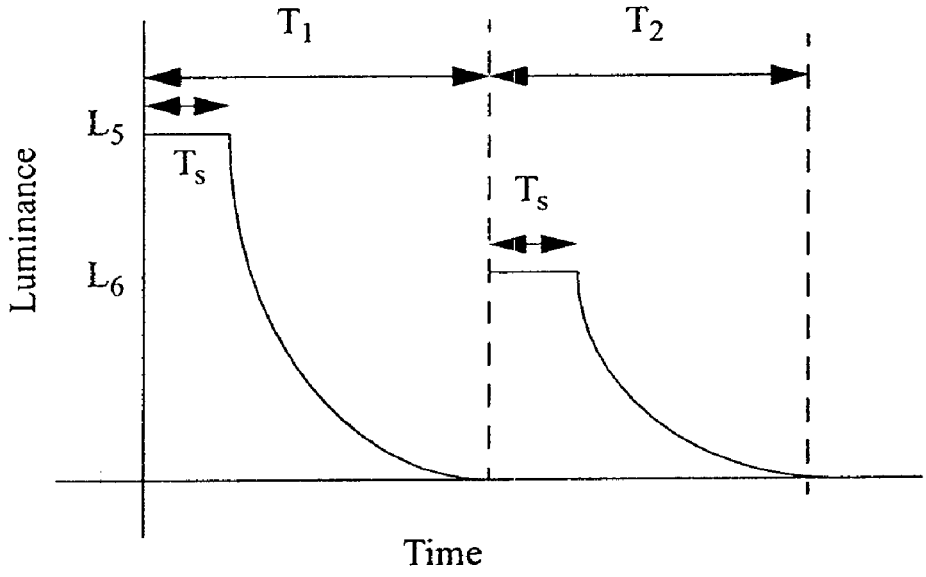
FIG. 7 is a timing diagram illustrating pixel luminance according to another embodiment of the present invention.

As shown in FIG. 7, by employing an external reduction-control signal 40 to control the timing of the luminance reduction compared to the selection of the pixel circuit to deposit charge in the storage circuit, the profile of the luminance emission is controlled, for example, by preventing any luminance reduction for a portion of the refresh period $T_s$. As noted above, to maintain a constant luminance perception, the total area under the curve should preferably be constant. Hence, an initial luminance level of $L_5$ is less than $L_3$ (for the first refresh period $T_1$) and an initial luminance level of $L_6$ is less than $L_4$ (for the second refresh period $T_2$). In this case, the controlled reduction of the luminance value is delayed until sometime after the deactivation of the select signal.

The illustrations of FIGS. 6 and 7 do not include the time in a refresh period required to store a luminance value in the storage circuit. Because the storage circuit is typically, but not necessarily, a capacitor storing a charge, any discharge mechanism (e.g. a resistor) may decrease the speed with which the charge is stored due to an impedance increase from the resistor and consequent transmission line losses. Hence, by employing a transistor that is deactivated during the charge storage portion of the refresh period, such transmission line losses can be reduced or avoided, thereby improving the rate at which luminance values are stored in each pixel circuit.

Figure 8:
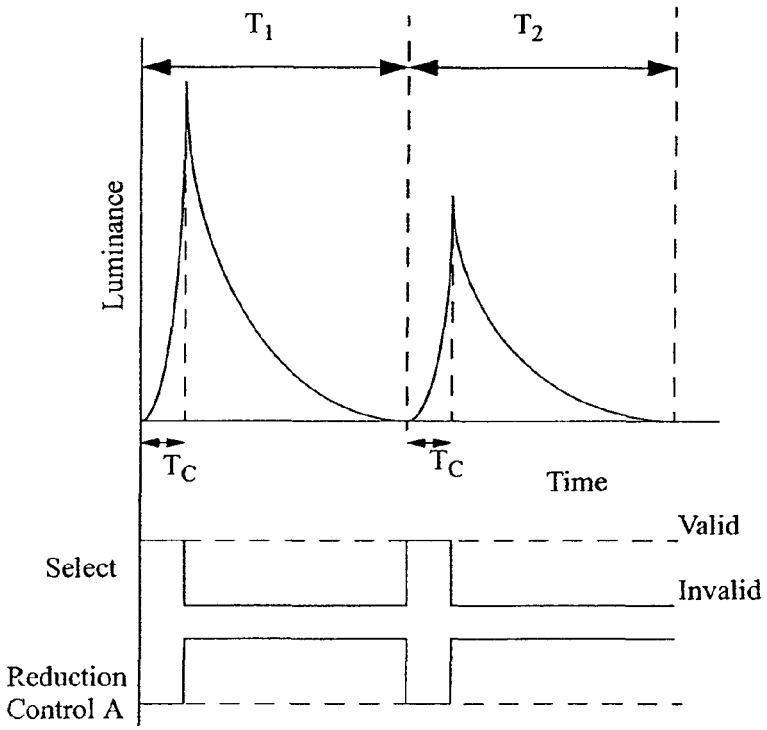
FIG. 8 is a more detailed timing diagram illustrating pixel luminance and including digital control signals according to an embodiment of the present invention.
Figure 9:
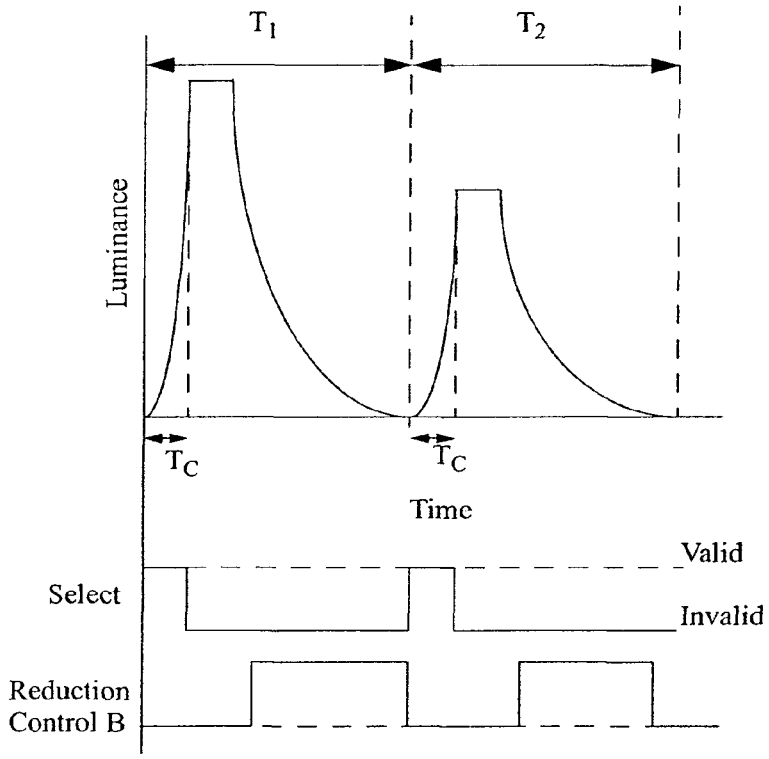
FIG. 9 is a more detailed timing diagram illustrating pixel luminance and including digital control signals according to an embodiment of the present invention.
Figure 10:
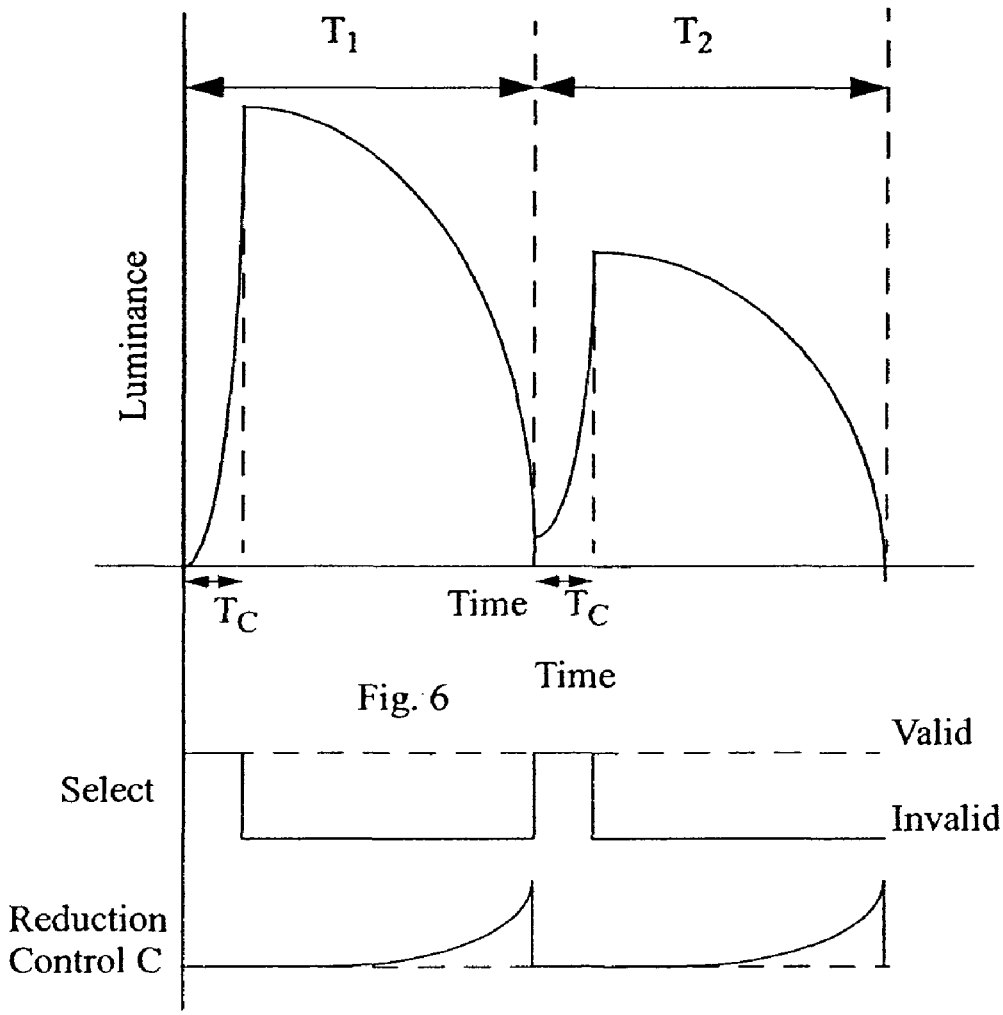
FIG. 10 is a more detailed timing diagram illustrating pixel luminance and including analog control signals according to an embodiment of the present invention.

Referring to FIG. 8, charge is stored in a storage circuit during a portion $T_C$ of a refresh period $T_1$ or $T_2$. The portion $T_C$ corresponds to the select signal valid state as illustrated with the select signal line illustrated. The reduction control signal A shows the corresponding inverted timing of the reduction-control signal. If more-complex control is desired, for example, the reduction-control timing B of FIG. 9 can be employed by delaying the luminance reduction. Both FIGS. 8 and 9 employ a digital reduction-control signal. However, the present invention can also employ analog control, as shown in FIG. 10. By controlling the luminance value reduction process, a wide variety of luminance-reduction profiles are achieved.

According to various embodiments of the present invention, a control transistor in series with the LED element itself (which series element would increases the voltage (Vdd) necessary to drive the LED, thereby decreasing the efficiency of the system) is not required, or a current-diverting transistor in parallel with the LED (which parallel element diverts current, thereby decreasing the efficiency of the system), while still providing a means to drive an active-matrix LED element with a decreasing luminance level within a single period.

As is known, deposit-and-hold circuits such as may be found in active-matrix OLED display devices of the prior art may lead to perceptual blurring, if an observer's eye attempts to track a moving object across the display device screen. By modulating the luminance value in the storage circuit to reduce the length of time the OLED is emitting light, this blurring effect may be reduced. Since the luminance output by a pixel according to the present invention decays more quickly than is true in conventional active-matrix control schemes, the blurring effect of holding a constant luminance over time while an observer's eye moves across a viewing field is reduced. The present invention can be employed to more simply reduce motion artifacts in such display devices.

It is known that in flat-panel displays the transistors formed on a substrate can have variable performance, in particular a variable threshold voltage. The present invention has an additional advantage in that for a portion of the refresh period (e.g. Ts), the driving transistor may be in a saturated driving state. Such a saturated state (the maximum at which the transistor can operate) is typically less subject to manufacturing variability and hence, the display can provide a more uniform appearance during this portion of the refresh cycle. Hence, in an additional embodiment of the present invention, the driving transistor is in a saturated state for some, but not all, of the refresh cycle, in response to the luminance value of the storage circuit.

In a typical pulse-width modulation scheme of the prior art, an LED is driven at a constant, high brightness for a data-dependant variable portion of a period. In this scheme, data is written at least twice in every period, to turn the LED on and off again. This scheme also requires that a large LED drive current be used, reducing the lifetime of the materials, and that a complex, very high-rate control signal be employed to control the variable pulse width. The variable pulse width is controlled to within at least one $256^{th}$ of a period to support an 8-bit gray-scale display. This can be difficult to accomplish. Hence, another advantage of the present invention is simplified control. For example, data may be written only once.

The present invention can also be employed to compensate for changes in the operating characteristics of an OLED element. As OLEDs are used, their efficiency drops and resistance increases. By controlling the luminance reduction within the first portion of a refresh period with respect to a second portion of the refresh period, more light is emitted by the device, thereby compensating for the reduced light output efficiency of the OLED element. Hence, in yet another exemplary embodiment of the present invention, the reduction-control signal is employed to compensate for OLED material aging. It can also be employed to compensate for uniformity variation by individually adjusting the reduction-control signal to vary the total amount of light emitted from the pixel in a refresh period.

Figure 14:
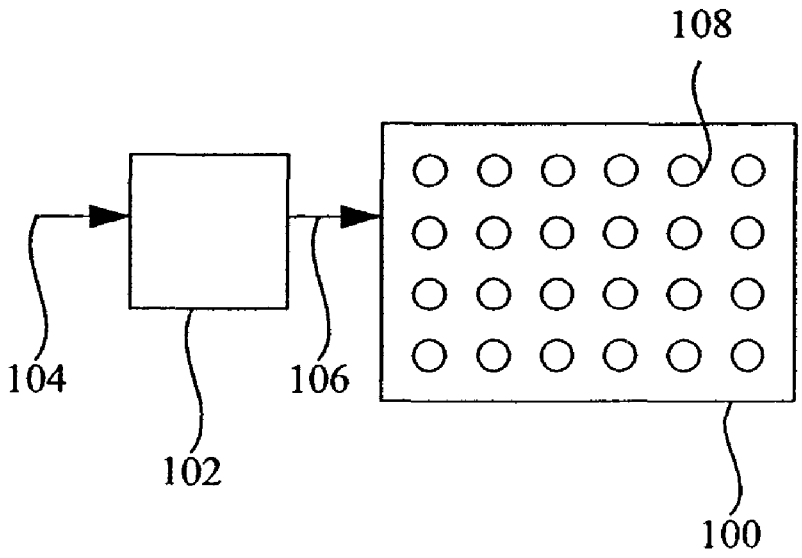
FIG. 14. is a block diagram illustrating a display system according to an embodiment of the present invention.

Referring to FIG. 14, the present invention can be employed in a display 100 having several light-emitting pixels 108, each pixel includes light-emitting elements that are responsive to current in order to emit light, and corresponding active-matrix pixel-driving circuits to control the light-emitting elements (e.g. corresponding to FIG. 1). These light-emitting pixels 108 are organized in rows and columns and the control signals supplied to them drive several rows or columns at a time. Each pixel-driving circuit can comprise a control circuit responsive to control signals for storing a luminance value in a storage circuit. A drive circuit is also included that is responsive to the storage circuit for controlling current through an LED to emit light at a luminance level determined by the luminance value. Additionally, a luminance-value reduction circuit is connected to the storage circuit for reducing s the luminance value stored in the storage circuit over time. The display 100 can be driven with signals 106 (including power and control signals) provided by a controller 102 responsive to input signals 104.

The reduction-control signal may be connected to all of the LED elements in common, so that a single control structure operates all of the modulation circuitry. Alternatively, separate reduction-control signals are employed for groups of OLEDs. These groups, for example, may comprise all of the LED elements that emit light of a particular color in a color display. Since different LED materials are employed in a color display to emit different colors and age at different rates, it can be advantageous to control each LED color-element grouping separately. Typically, the data and select control signals refresh lines or columns in a display at a time. The same method of cycling through the rows or columns may be employed to control the modulation signal so that each LED commonly connected to a modulation signal will be updated one row or column at a time and cause the LED to emit light for the same amount of time.

Figure 15:
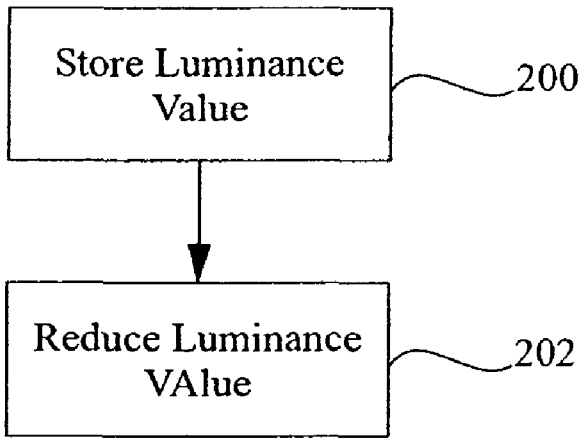
FIG. 15 is a flow diagram illustrating a method according to an embodiment of the present invention.

An LED controller suitable for use with the present invention can be constructed using conventional digital logic control methods. The circuit control signals may be applied using conventional designs. Referring to FIG. 15, such a controller implements a method of reducing luminance of a display device within a frame period by employing an LED pixel control signal to, in step 200, store a luminance value in a storage circuit to control current through an LED to emit light at a luminance level determined by the luminance value and in step 202 control the reduction of the luminance value within a frame period by employing a luminance-value reduction circuit connected to the storage circuit to reduce the luminance value stored in the storage circuit.

In a preferred embodiment, the invention is employed in an emissive display that includes Organic Light Emitting Diodes (OLEDs) which are composed of small molecule or polymeric OLEDs as disclosed in but not limited to U.S. Pat. No. 4,769,292, issued Sep. 6, 1988 to Tang et al., entitled, "Electroluminescent Device with Modified Thin Film Luminescent Zone" and U.S. Pat. No. 5,061,569, issued Oct. 29, 1991 to VanSlyke et al., entitled, "Electroluminescent Device with Organic Electroluminescent Medium". Many combinations and variations of OLED materials and architectures are available to those knowledgeable in the art, and can be used to fabricate an OLED display device according to the present invention. In an alternative embodiment, the invention is employed with inorganic light-emitting materials, for example, phosphorescent crystal or quantum dots within a polycrystalline semiconductor matrix.

The invention has been described in detail with particular reference to certain preferred embodiments thereof, but it will be understood that variations and modifications can be effected within the spirit and scope of the invention.

PARTS LIST

8 active-matrix control circuit
10 light-emitting diode
12 control transistor
14 select signal
15 control signals
16 data signal
20 capacitor
22 drive transistor
24 resistor
26 luminance-value-reduction transistor
28 reduction-control transistor
30 control circuit
32 storage circuit
34 drive circuit
36 luminance-value-reduction circuit
38 reduction-control circuit
40 reduction-control signal
42 inverter
44 inverter transistor
100 display
102 controller
104 signal
106 signal
108 light-emitting elements
200 store luminance value step
202 reduce luminance value step

The invention claimed is:

1. An active-matrix circuit for controlling an LED display pixel, the active-matrix circuit comprising:

a control circuit responsive to control signals for storing a luminance value in a storage circuit during a frame period;

a drive circuit responsive to the storage circuit for controlling current through an LED to emit light at a luminance level determined by the luminance value;

a luminance-value reduction circuit connected to the storage circuit that controls a reduction of the luminance value stored in the storage circuit during the frame period; and a reduction-control circuit responsive to a reduction-control signal connected to the luminance-value reduction circuit to control rate at which the luminance value reduction circuit reduces the luminance value, wherein the reduction-control circuit is a transistor, and wherein:

the storage circuit comprises a capacitor for storing a charge representative of the luminance value, the luminance-value reduction circuit comprises a resistor connected in parallel across the capacitor, and the reduction-control transistor comprises connected in series with the resistor to control the flow of current through the resistor in response to the reduction-control signal.

2. The active-matrix circuit of claim 1, wherein the control circuit or drive circuit comprises transistors formed on a substrate.

3. The active-matrix circuit of claim 1, wherein the storage circuit comprises a capacitor for storing a charge representative of the luminance value.

4. The active-matrix circuit of claim 3, wherein the luminance-value reduction circuit decreases the charge stored in the capacitor over time.

5. The active-matrix circuit of claim 4, wherein the luminance-value reduction circuit comprises a resistor connected in parallel across the capacitor.

6. The active-matrix circuit of claim 4, wherein the luminance-value reduction circuit comprises a transistor connected in parallel across the capacitor and responsive to a control signal to control rate at which the charge in the capacitor decreases over time.

7. The active-matrix circuit of claim 1, wherein:

the control signals include a select signal for controlling the control circuit; and the reduction-control signal comprises an inverse signal of the select signal.

8. The active-matrix circuit of claim 7, wherein the reduction-control circuit comprises an inverter.

9. The active-matrix circuit of claim 8, wherein the inverter comprises a transistor.

10. The active-matrix circuit of claim 1, wherein the controlled reduction begins, without substantial delay, after the luminance value is stored in the storage circuit.

11. The active-matrix circuit of claim 1, wherein the luminance value decreases continuously after the luminance value is stored in the storage circuit.

12. An active-matrix circuit for controlling an LED display pixel, the active-matrix circuit comprising:

a control circuit responsive to control signals for storing a luminance value in a storage circuit during a frame period;

a drive circuit responsive to the storage circuit for controlling current through an LED to emit light at a luminance level determined by the luminance value;

a luminance-value reduction circuit connected to the storage circuit that controls a reduction of the luminance value stored in the storage circuit during the frame period, wherein the luminance value is held at a constant value for a first period less than the frame period after the luminance value is stored in the storage circuit and then is reduced at the conclusion of the first period.

13. A display device, comprising:

a plurality of light-emitting pixels formed over a substrate, each pixel including a light-emitting diode (LED) responsive to current to emit light and a pixel-driving circuit for providing current to the LED, each pixel-driving circuit further comprising:

a control circuit responsive to control signals for storing a luminance value in a storage circuit;

a drive circuit responsive to the storage circuit for controlling current through an LED to emit light at a luminance level determined by the luminance value;

a luminance-value reduction circuit connected to the storage circuit that reduces the luminance value stored in the storage circuit over time; and a reduction-control circuit responsive to a reduction-control signal connected to the luminance-value reduction circuit to control rate at which the luminance value reduction circuit reduces the luminance value, wherein the reduction-control circuit is a transistor, and wherein:

the storage circuit comprises a capacitor for storing a charge representative of the luminance value, the luminance-value reduction circuit comprises a resistor connected in parallel across the capacitor, and the reduction-control transistor comprises connected in series with the resistor to control the flow of current through the resistor in response to the reduction-control signal.

14. The display device of claim 13 wherein the LEDs comprise organic light-emitting diodes.

15. The display device of claim 13 wherein the LEDs comprise inorganic light-emitting diodes.

16. The display device of claim 13 wherein the inorganic LEDs comprise quantum dots in a polycrystalline semiconductor matrix.

17. A method of reducing luminance of a display device within a frame period, the method comprising:

employing an LED pixel control signal to store a luminance value in a storage circuit to control current through an LED to emit light at a luminance level determined by the luminance value; and controlling the reduction of the luminance value within a frame period by employing a luminance-value reduction circuit connected to the storage circuit to reduce the luminance value stored in the storage circuit, wherein the luminance value is held at a constant value for a first period less than the frame period after the luminance value is stored and then is reduced at the conclusion of the first period.

* * * * *